US012611567B2

(12) United States Patent
Abo-Auda et al.

(10) Patent No.: US 12,611,567 B2
(45) Date of Patent: Apr. 28, 2026

(54) APPARATUS FOR GUIDING AND SUPPORTING USERS TO MAINTAIN CORRECT POSTURES DURING SQUATTING EXERCISE

(71) Applicant: CARDIO VOYAGE INNOVATIONS, LLC., McKinney, TX (US)

(72) Inventors: Wael Saleem Abo-Auda, Allen, TX (US); Saleem Wael Abo-Auda, Allen, TX (US); Sheik Ahamed Azigar Ali, Frisco, TX (US); Zain Mallick, Frisco, TX (US); Faiza Mallick, Frisco, TX (US)

(73) Assignee: CARDIO VOYAGE INNOVATIONS, LLC., McKinney, TX (US)

( * ) Notice: Subject to any disclaimer, the term of this patent is extended or adjusted under 35 U.S.C. 154(b) by 104 days.

(21) Appl. No.: 18/786,467

(22) Filed: Jul. 27, 2024

(65) Prior Publication Data

US 2026/0027407 A1 Jan. 29, 2026

(51) Int. Cl.

| | |
|---|---|
| ***A63B 21/00*** | (2006.01) |
| ***A63B 23/04*** | (2006.01) |
| ***A63B 71/06*** | (2006.01) |

(52) U.S. Cl.

CPC ..... *A63B 21/4034* (2015.10); *A63B 23/0405* (2013.01); *A63B 71/0619* (2013.01); *A63B 2023/0411* (2013.01); *A63B 2220/56* (2013.01); *A63B 2225/09* (2013.01); *A63B 2230/01* (2013.01)

(58) Field of Classification Search

CPC ..... A63B 21/4034; A63B 23/0405; A63B 71/0619; A63B 2023/0411; A63B 2220/56; A63B 2225/09; A63B 2230/01

See application file for complete search history.

(56) References Cited

U.S. PATENT DOCUMENTS

| | | | | |
|---|---|---|---|---|
| 2,682,437 | A * | 6/1954 | Howard | A61G 13/0009 5/602 |
| 3,902,717 | A * | 9/1975 | Kulkens | A63B 21/4047 482/130 |
| 4,363,493 | A * | 12/1982 | Veneklasen | A63C 17/08 280/11.24 |
| 5,628,715 | A * | 5/1997 | Simonson | A63B 21/4047 482/137 |
| 7,648,444 | B2 * | 1/2010 | Johnson | A63B 22/16 482/52 |

(Continued)

*Primary Examiner* — Garrett K Atkinson

(74) *Attorney, Agent, or Firm* — Haynes & Boone, LLP

(57) ABSTRACT

A portable and foldable apparatus supporting a user in maintaining correct posture during squatting is provided. The apparatus comprises a pair of footplates, a pair of telescoping arms, a stance pivot knob that adjusts angular distance between a first telescopic arm and a second telescopic arm, a knee stopper knob for each of the pair of footplates, a knee stopper that includes at least a first bar, a second bar, and a third bar. The first bar restricts forward knee movement of the user during squatting. The second bar restricts inward knee movement of the user during squatting. The knee stopper knob allows forward or backward movement of the third bar to adjust a horizontal distance between the first bar and an end portion of the corresponding footplate and a vertical distance between the first bar and the corresponding footplate.

15 Claims, 11 Drawing Sheets

(56) References Cited

U.S. PATENT DOCUMENTS

| | | | | |
|---|---|---|---|---|
| 7,794,372 | B1 * | 9/2010 | Webber | A63B 21/0628 482/142 |
| 9,168,165 | B2 * | 10/2015 | Terrio | A63B 71/0054 |
| 10,646,745 | B2 * | 5/2020 | Crowley | A63B 71/0054 |
| 2004/0209752 | A1 * | 10/2004 | Thonn, Jr. | A63B 21/4047 482/123 |
| 2004/0248713 | A1 * | 12/2004 | Campanaro | A63B 21/068 482/123 |
| 2017/0014663 | A1 * | 1/2017 | Jones-Guinasso | A63B 21/4035 |
| 2017/0112338 | A1 * | 4/2017 | Cheng | A47K 17/028 |
| 2018/0104526 | A1 * | 4/2018 | Kelly | A63B 21/0615 |
| 2019/0209890 | A1 * | 7/2019 | Moreno | A63B 21/4035 |
| 2020/0061803 | A1 * | 2/2020 | Wang | A61H 1/0237 |
| 2021/0007874 | A1 * | 1/2021 | Galiana Bujanda | A61F 5/028 |
| 2023/0033831 | A1 * | 2/2023 | Lupoli | A63B 21/4047 |

* cited by examiner

APPARATUS FOR GUIDING AND SUPPORTING USERS TO MAINTAIN CORRECT POSTURES DURING SQUATTING EXERCISE

TECHNICAL FIELD

This disclosure relates generally to an apparatus for guiding and supporting a user during exercise, and more particularly to an apparatus for guiding and supporting a user to maintain correct postures during squatting exercise.

BACKGROUND

Squatting is an extremely common exercise practiced by individuals ranging from beginners to professional athletes. It is used to enhance strength, endurance, stability, and density of the muscles, bones, tendons, and ligaments of the legs. The quadriceps, glutes, hamstrings, calves, and even the core (abdominal muscles) are effectively trained through squatting. Despite its apparent simplicity, executing a proper squat technique can be challenging, and is essential to ensure the targeted muscles are engaged correctly and to prevent injury.

Moreover, improper squatting technique may lead to injuries in the lower back, hips, and knees. Common mistakes include knee valgus (leaning the knees inward), initiating the squat by bending at the knees rather than the hips, and pushing the knees excessively over the toes. These errors increase the load on the knee joints, potentially causing medial collateral ligament (MCL), anterior cruciate ligament (ACL), meniscus, and hip damage. Additionally, other mistakes may not lead to injury but may reduce the squat's effectiveness in activating target muscles like the quadriceps.

Therefore, there is a need for a device designed to help individuals by providing proper guide for their squatting exercise and ensuring perfect form and technique, which reduces the risk of injury.

SUMMARY OF INVENTION

In an embodiment, a portable and foldable apparatus supporting a user in maintaining correct posture during squatting is disclosed. The apparatus includes a pair of footplates to accommodate feet of the user. The apparatus further includes a pair of telescoping arms such that a first telescoping arm of the pair of telescoping arms is connected to a first foot plate of the pair of footplates and a second telescoping arm of the pair of telescoping arms is connected to a second foot plate of the pair of footplates. The apparatus further includes a stance pivot knob that connects the first telescopic arm with the second telescopic arm and configured to adjust angular distance between the first telescopic arm and the second telescopic arm. The apparatus further includes a knee stopper knob for each of the pair of footplates and a knee stopper for each of the pair of footplates. The knee stopper includes at least a first bar, a second bar, and a third bar. The third bar is adjustably connected to a corresponding foot plate of the pair of footplates via the knee stopper knob. The first bar is orthogonally connected to the second bar. The second bar is connected to the third bar at a specific angle. The first bar restricts forward knee movement of the user during squatting. The second bar restricts inward knee movement of the user during squatting. The knee stopper knob is configured to allow forward or backward movement of the third bar to adjust a horizontal distance between the first bar and an end portion of the corresponding foot plate and a vertical distance between the first bar and the corresponding foot plate.

In an embodiment, the apparatus may further comprise a foot plate angle knob for each of the pair of footplates. The foot plate angle knob adjustably connects each telescopic arm with the corresponding foot plate. The foot plate angle knob is configured to allow adjustment of angular distance between each telescopic arm and a side of the corresponding foot plate.

In an embodiment, the apparatus may further comprise a pair of anti-skid pads, wherein each anti-skid pad of the pair of skid pads is disposed on the corresponding foot plate.

In an embodiment, each telescopic arm of the pair of telescopic arms may extend or retract with respect to a point of connection with the corresponding foot plate to accommodate different types of squats.

In an embodiment, the apparatus may further comprise a wedge on each foot plate of the pair of footplates which may allow the user to perform inclined squatting exercise.

In an embodiment, the apparatus may further comprise a processor. Each footplate of the pair of footplates may comprise a first plurality of pressure sensors disposed on each footplate along tripod foot positions. Each pressure sensor of the first plurality of pressure sensors may detect a weight exerted by the user at a specific position on the corresponding footplate during squatting and output the detected weight to the processor.

In an embodiment, a first position in the tripod foot positions corresponds to a position where a heel of the user contacts the corresponding foot plate, a second position in the tripod foot positions corresponds to a position where a big toe of the user contacts the corresponding foot plate, and a third position in the tripod foot positions corresponds to a position where a pinky toe of the user contacts the corresponding foot plate.

In an embodiment, the processor associated with the apparatus may determine distribution of weight along the tripod foot positions based on the detected weight. The processor may output a signal to notify the user based on the determination that the distribution of weight along the tripod foot positions is uneven.

In an embodiment, the processor of the apparatus may control, based on the output signal, at least one of a speaker, a display screen, or a haptic device to notify the user about the uneven distribution of weight along the tripod foot positions.

In an embodiment, the processor of the apparatus may determine the distribution of weight to be uneven when weights on the tripod foot positions are unequal.

In an embodiment, the apparatus may further comprise a second plurality of sensors disposed on the first bar of the knee stopper. The second plurality of sensors may detect pressure applied on the first bar due to forward knee movement of the user during squatting and output the detected pressure to the processor.

In an embodiment, the processor associated with the apparatus may determine an extent of the forward knee movement of the user during squatting, based on the detected pressure on the first bar. The processor may output a signal to notify the user based on the determination that the extent of the forward knee movement is greater than a threshold value.

In an embodiment, the processor associated with the apparatus may receive, from at least one image capturing device, at least one image of the user during squatting. The processor may control creation of an avatar of the user based on the at least one image of the user during squatting, the weight detected by the first plurality of sensors, and the pressure detected by the second plurality of sensors. The processor may further control a display screen to display the avatar of the user during squatting.

In an embodiment, the processor associated with the apparatus may compare movements of the avatar during squatting with pre-stored movements. Based on the movements of the avatar being different from the pre-stored movements by a threshold value, the processor may control the display screen to display a message that notifies the user of incorrect movements during squatting.

In an embodiment, the processor associated with the apparatus may control, based on the output signal, at least one of a speaker, a display screen, or a haptic device to notify the user about the forward knee movement being extended beyond the threshold value.

It is to be understood that both the foregoing general description and the following detailed description are exemplary and explanatory only and are not restrictive of the invention, as claimed.

BRIEF DESCRIPTION OF THE DRAWINGS

The present application can be best understood by reference to the following description taken in conjunction with the accompanying drawing figures, in which like parts may be referred to by like numerals.

DETAILED DESCRIPTION OF THE DRAWINGS

The following description is presented to enable a person of ordinary skill in the art to make and use the invention and is provided in the context of particular applications and their requirements. Various modifications to the embodiments will be readily apparent to those skilled in the art, and the generic principles defined herein may be applied to other embodiments and applications without departing from the spirit and scope of the invention. Moreover, in the following description, numerous details are set forth for the purpose of explanation. However, one of ordinary skill in the art will realize that the invention might be practiced without the use of these specific details. In other instances, well-known structures and devices are shown in block diagram form in order not to obscure the description of the invention with unnecessary detail. Thus, the invention is not intended to be limited to the embodiments shown, but is to be accorded the widest scope consistent with the principles and features disclosed herein.

While the invention is described in terms of particular examples and illustrative figures, those of ordinary skill in the art will recognize that the invention is not limited to the examples or figures described. Those skilled in the art will recognize that the operations of the various embodiments may be implemented using hardware, software, firmware, or combinations thereof, as appropriate. For example, some processes can be carried out using processors or other digital circuitry under the control of software, firmware, or hard-wired logic. (The term "logic" herein refers to fixed hardware, programmable logic and/or an appropriate combination thereof, as would be recognized by one skilled in the art to carry out the recited functions.) Software and firmware can be stored on computer-readable storage media. Some other processes can be implemented using analog circuitry, as is well known to one of ordinary skill in the art. Additionally, memory or other storage, as well as communication components, may be employed in embodiments of the invention.

Figure 1:
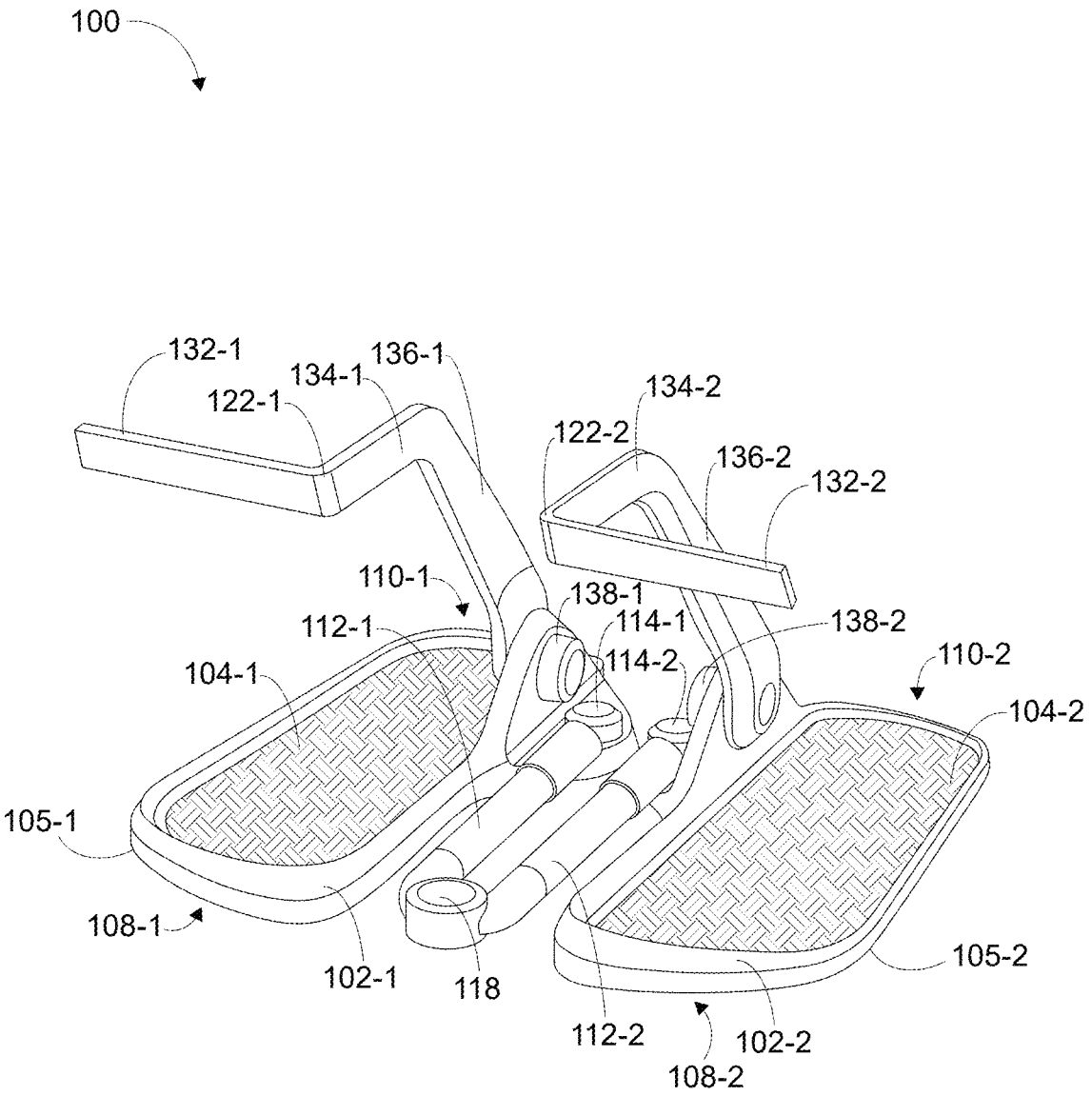
FIG. 1 illustrates a perspective view of an apparatus for guiding and supporting a user during squatting exercise, in accordance with an embodiment of the present disclosure.

Referring to FIG. 1, a perspective view of an apparatus 100 for guiding and supporting a user during squatting exercise is illustrated, in accordance with an embodiment of the present disclosure. The apparatus 100 may be used for maintaining correct postures during the squatting exercise. The apparatus 100 may provide a lightweight, compact and portable solution for maintaining correct postures during the squatting exercise. The apparatus 100 includes a pair of footplates 102, such as, a first foot plate 102-1 and a second foot plate 102-2. The bottom surfaces of the first foot plate 102-1 and the second foot plate 102-2 are coplanar. The pair of footplates 102-1, 102-2 is adapted to accommodate feet of the user on the apparatus 100. For example, the first foot plate 102-1 accommodates a first foot of the user and the second foot plate 102-2 accommodates a second foot of the user. In an exemplary embodiment, the first foot may be a right foot of the user and the second foot may be a left foot of the user.

Figure 2:
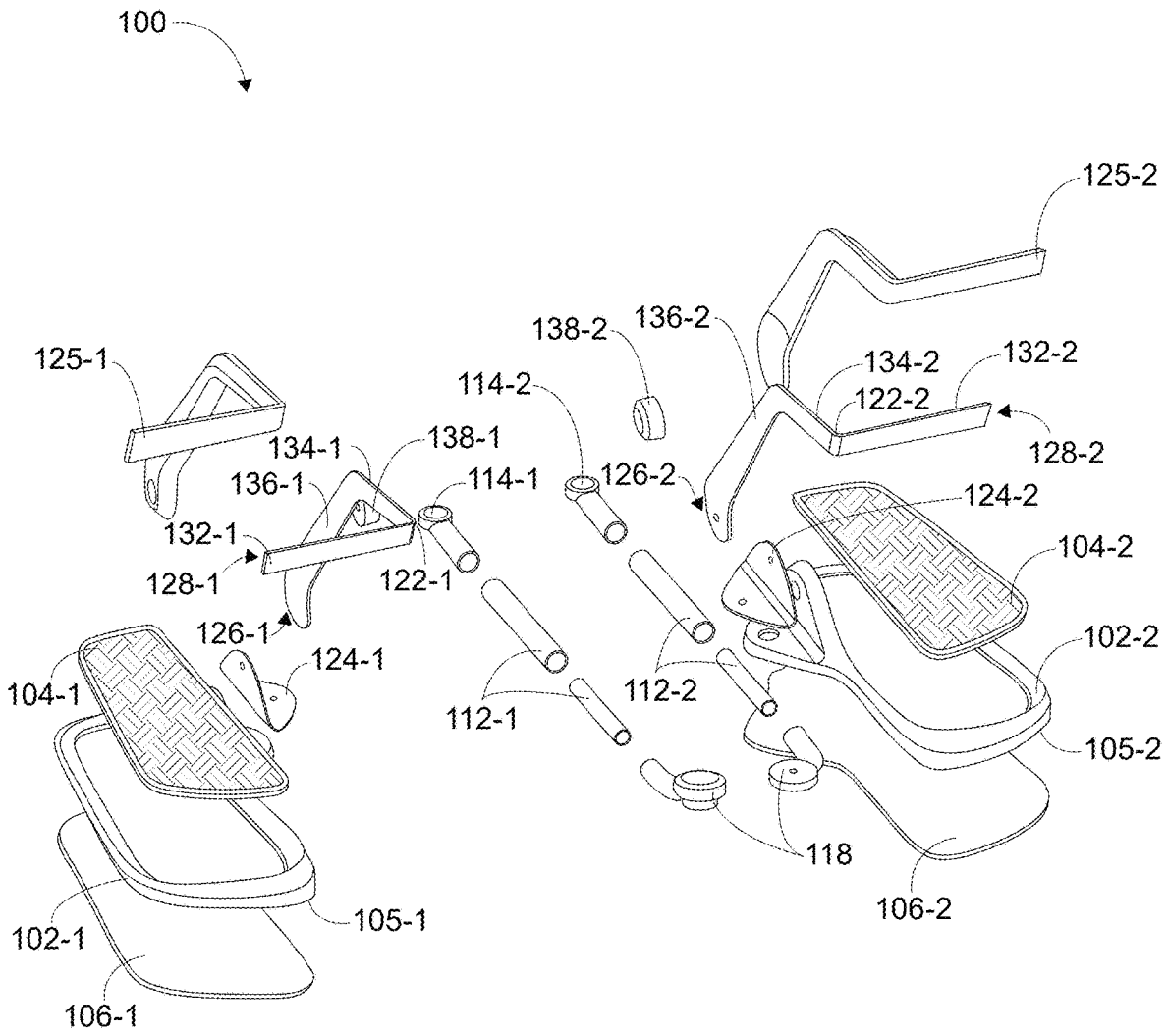
FIG. 2 illustrates an exploded view of the apparatus of FIG. 1, in accordance with an embodiment of the present disclosure.

FIG. 2 illustrates an exploded view of the apparatus 100, in accordance with an embodiment of the present disclosure. The apparatus 100 further includes a pair of anti-skid pads 104 disposed on the corresponding footplates 102. For example, a first anti-skid pad 104-1 is disposed on the first foot plate 102-1 and a second anti-skid pad 104-2 is disposed on the second foot plate 102-2. The pair of anti-skid pads 104 provides friction between the associated foot plate 102 and the user's shoes to prevent slipping within the apparatus 100 and anchor the feet of the user while squatting.

The apparatus 100 may further include a pair of lower anti-skid pads 106 disposed on a bottom surface 105 of the pair of footplates 102. For example, a first lower anti-skid pad 106-1 is disposed on the bottom surface 105-1 of the first foot plate 102-1 and a second lower anti-skid pad 106-2 is disposed on the bottom surface 105-2 of the second foot plate 102-2. The pair of lower anti-skid pads 106 provides friction between the ground surface and the associated foot plate 102 to ensure no slipping condition of each foot plate 102-1, 102-2 while squatting. In some embodiments, the pair of lower anti-skid plates 106 may be omitted and the bottom surface 105 of each corresponding footplates 102 may directly contact the ground surface.

Referring now to FIGS. 1 and 2, each of the footplates 102-1, 102-2 extends in a longitudinal direction from a front end 108 to a rear end 110 disposed opposite to the front end 108. Further, the apparatus 100 includes a pair of telescoping arms 112, such as, a first telescopic arm 112-1 and a second telescopic arm 112-2, corresponding to each footplates 102. The first telescopic arm 112-1 of the pair of telescopic arms is connected to the first foot plate 102-1 of the pair of foot plate and the second telescopic arm 112-2 of the pair of telescopic arms is connected to the second foot plate 102-2 of the pair of footplates. As shown in FIG. 1, the first telescopic arm 112-1 is connected proximal to the rear end 110-1 of the first foot plate 102-1 and the second telescopic arm 112-2 is connected proximal to the rear end 110-2 of the second foot plate 102-2.

The apparatus 100 further includes a foot plate angle knob 114 for each of the pair of footplates 102. In an example, a foot plate angle knob 114-1 is provided for the foot plate 102-1 and a foot plate angle knob 114-2 is provided for the foot plate 102-2. Specifically, each of the telescopic arms 112 is connected to the corresponding footplates 102 via the associated foot plate angle knob 114. The foot plate angle knob 114 adjustably connects each telescopic arm 112 with the corresponding foot plate 102. The foot plate angle knob 114 may allow adjustment of angular distance between each telescopic arm 112 and a side 116 of the corresponding foot plate 102. In other words, the foot plate angle knob 114 allows a rotation of each telescopic arm 112 relative to the side 116 of the corresponding foot plate 102. Details of the side 116 and adjustment of the angular distance between the side 116 and the corresponding foot plate 102 is explained with reference to description and illustration of FIG. 5.

The apparatus 100 further includes a stance pivot knob 118 that connects the first telescopic arm 112-1 with the second telescopic arm 112-2. The stance pivot knob 118 may adjust angular distance between the first telescopic arm 112-1 and the second telescopic arm 112-2. The user may adjust the stance pivot knob 118 to change the angular distance between the first telescopic arm 112-1 and the second telescopic arm 112-2 based on different types of squats. Accordingly, the pair of footplates 102 may be arranged with different angular distances between the pair of telescopic arms adjustable using the stance pivot knob 118. This enables the user to perform squats with different stances. The position of feet while squatting defines a stance of the squat. The squat stance is different for every person and a person needs to decide as which stance suits best after carefully analyzing different squat stances. Additionally, different stances allow for a movement that produces more work at a specific body part, for example, hips. In an example, wide stance squats allow for a movement that produces more work at the hips than traditional squats. The stance pivot knob 118 enables the apparatus 100 to adjust for different stance type and make the apparatus 100 a versatile exercise apparatus suited best for each squat stance.

Other than the feature of adjustable angular distance between the telescopic arms that allows the user to perform different squat stance types, another feature that adds another degree of flexibility to perform different squat stance types is the extension or retraction of the telescopic arms 112 with respect to a point of connection with the corresponding foot plate 102. The pair of telescopic arms 112 may be arranged in a plurality of positions between an extended position and a contracted position based upon the user's preference. A length of the telescopic arm in the extended position is larger than a length of the telescopic arm in the retracted position.

In an embodiment, the combination of angular distance between the telescopic arms and the extension/retraction of the telescopic arms allows the apparatus 100 to become usable for different squad stance types.

Figure 3:
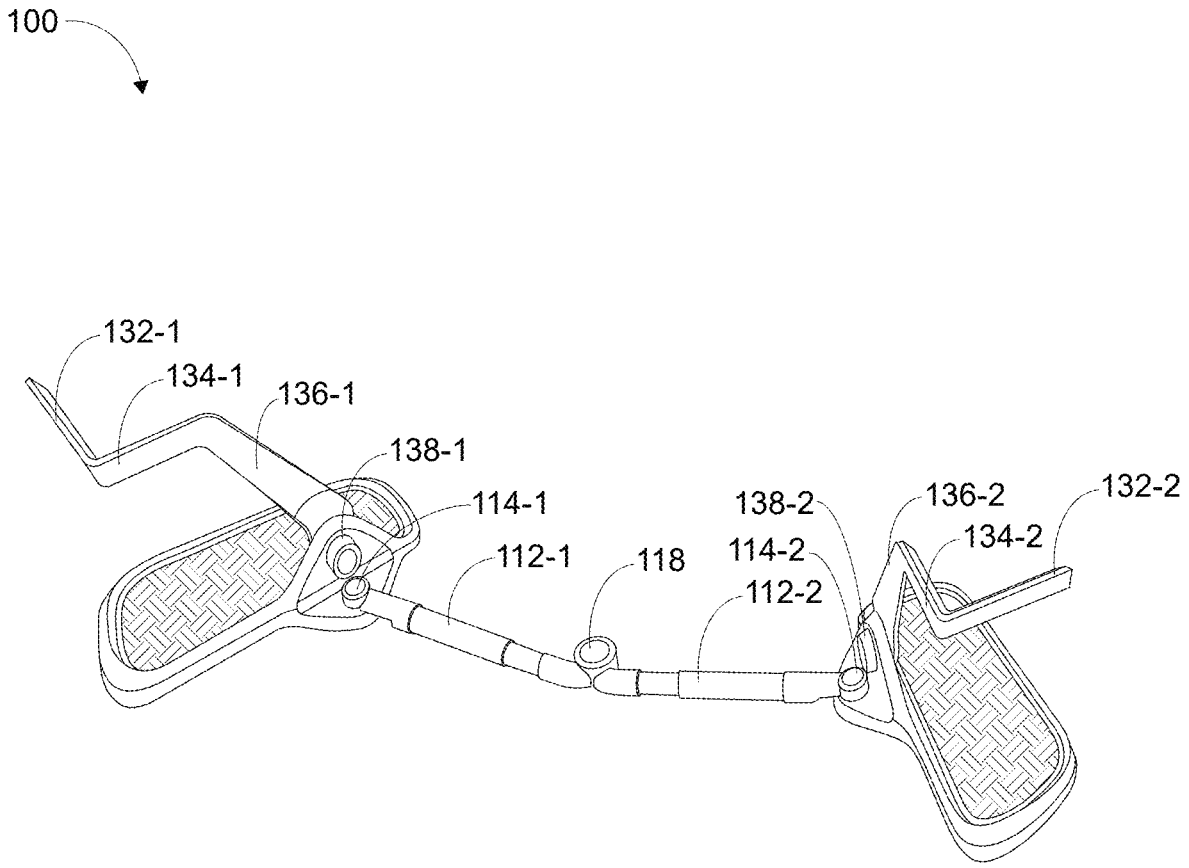
FIG. 3 illustrates a perspective view of the apparatus of FIG. 1 with a pair of telescopic arms arranged in an extended position, in accordance with an embodiment of the present disclosure.

FIG. 3 illustrates a perspective view of the apparatus 100 with the pair of telescopic arms 112 arranged in an exemplary extended position, according to an embodiment of the present disclosure. Without restricting the scope of the disclosure, it would be appreciated that more such postures are possible by extending/retracting the telescopic arms 112 and adjusting the stance pivot knob 118. As shown in FIG. 3, however not limited to such a use case only, in the extended position of the apparatus 100, the pair of telescopic arms 112 may be arranged substantially linear to each other.

Figure 4:
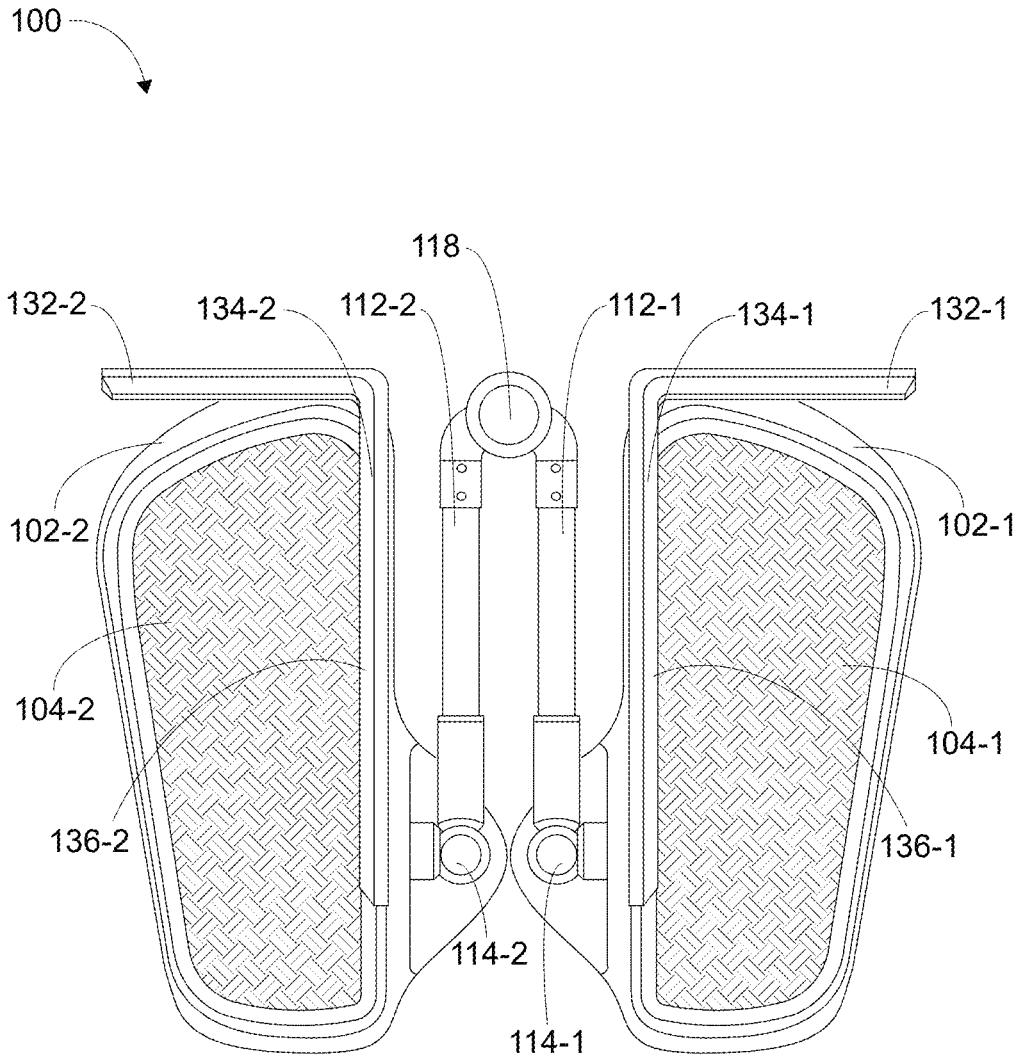
FIG. 4 illustrates a perspective view of the apparatus of FIG. 1 with the pair of telescopic arms arranged in a contracted position, in accordance with an embodiment of the present disclosure.

FIG. 4 illustrates a perspective view of the apparatus 100 with the pair of telescopic arms 112 arranged in the contracted position. Without restricting the scope of the disclosure, it would be appreciated that more such postures are possible by extending/retracting the telescopic arms 120 and adjusting the stance pivot knob 118. As shown in FIG. 4, however not limited to such a use case only, in the contracted position, the pair of telescopic arms 112 is arranged parallel to each other.

Figure 5:
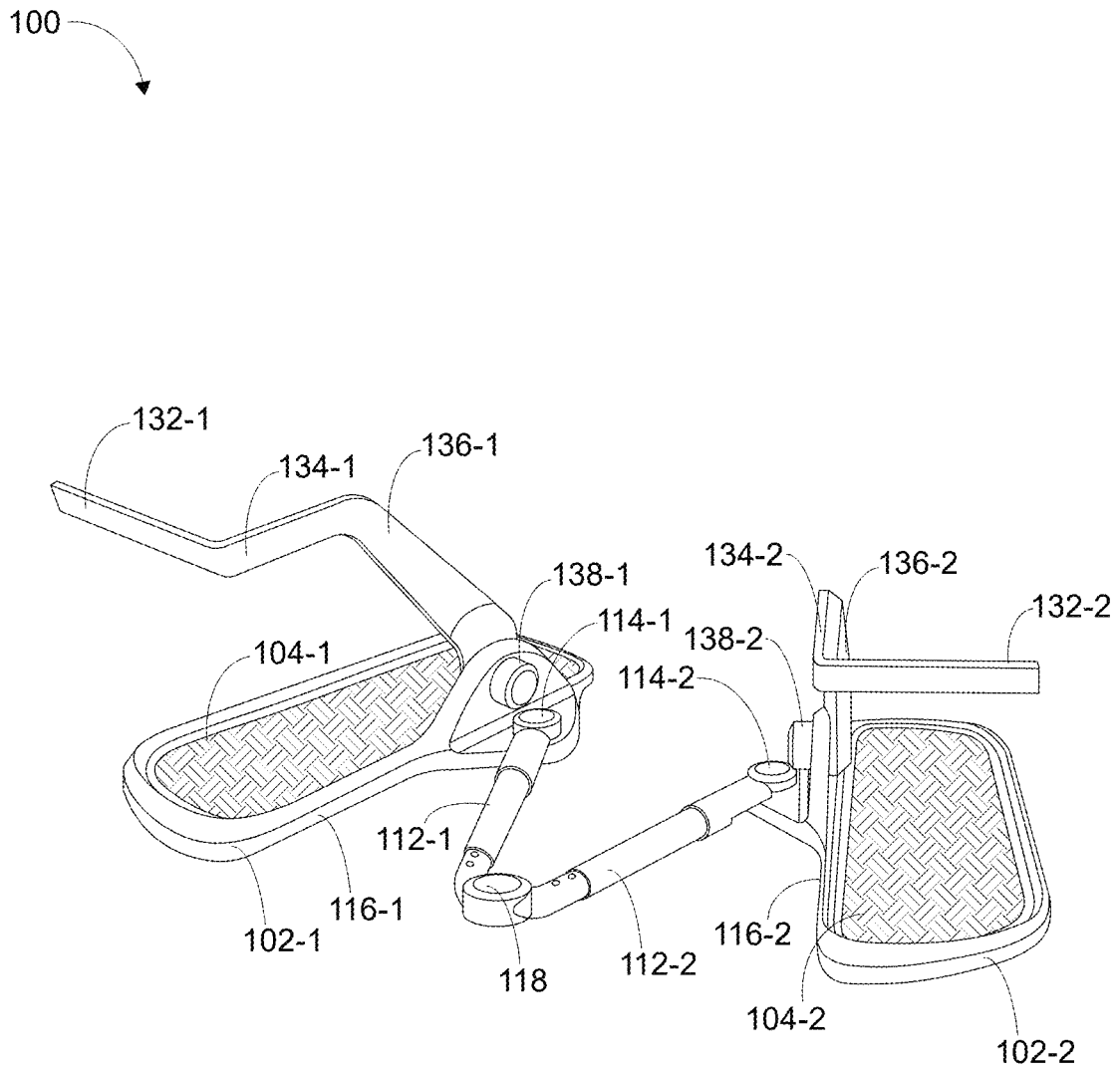
FIG. 5 illustrates a perspective view of the apparatus of FIG. 1 with the pair of telescopic arms arranged in an exemplary position between the extended position and the contracted position, in accordance with an embodiment of the present disclosure.

FIG. 5 illustrates a perspective view of the apparatus 100 with the pair of telescopic arms 112 arranged in a specific position between the extended position and the contracted position. Moreover, the pair of telescopic arms 112 may be arranged in a plurality of positions between the extended position and the contracted position. An angular distance between the telescopic arms 112 in the specific position as illustrated by FIG. 5 is greater than an angular distance between the telescopic arms 112 in the contracted position as illustrated by FIG. 4 and smaller than an angular distance between the telescopic arms 112 in the extended position as illustrated by FIG. 3.

In another embodiment (not illustrated by FIGS. 3, 4, and 5), a length of the pair of telescopic arms may be greater in the extended position than the contracted position. In other words, the pair of telescopic arms may be extended in the extended position and retracted in the contracted position.

Figure 6:
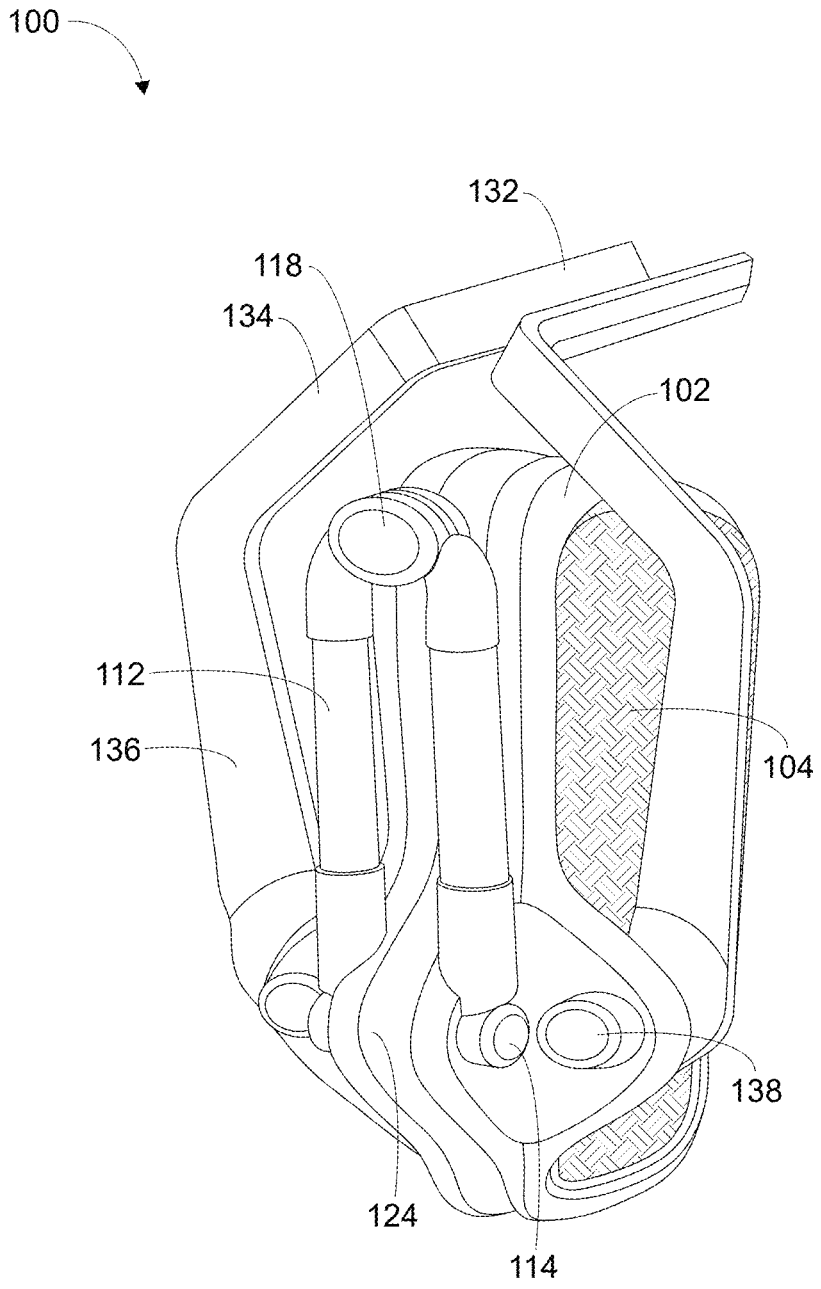
FIG. 6 illustrates a perspective view of the apparatus of FIG. 1 arranged in a folded configuration, in accordance with an embodiment of the present disclosure.

FIG. 6 illustrates a perspective view of the apparatus 100 arranged in a folded configuration, according to an embodiment of the present disclosure. In the folded configuration, each of the telescopic arms 112 is arranged parallel to each other such that the bottom surface 105 of each of the foot plate 102 is arranged facing each other to facilitate a folding of the apparatus 100. In some embodiments, the bottom surface 105 of each of the foot plate 102-1, 102-2 may be arranged abutting each other in the folded configuration. The folded configuration of the apparatus 100 facilitates easy storage and hassle-free transportation of the apparatus 100 from one location to another.

Referring to FIGS. 1 to 6, the apparatus 100 further includes a knee stopper 122 for each of the pair of footplates 102. In an example, a knee stopper 122-1 is provided for the foot plate 102-1 and a knee stopper 122-2 is provided for the foot plate 102-2. Each of the knee stopper 122 is coupled towards the rear end 110 of the corresponding footplates 102. For example, the first knee stopper 122-1 is coupled to the rear end 110-1 of the first foot plate 102-1 and the second knee stopper 122-2 is coupled to the rear end 110-2 of the second foot plate 102-2. Each of the knee stopper 122 is adapted to restrict/prevent an undesired knee movement of the user during the squatting by at least partially contacting the legs (i.e., lower legs) of the user. In other words, each of the knee stoppers 122 guides the knee movement in a desired direction during the squatting.

In some embodiments, each of the knee stopper 122 may be coupled to the corresponding foot plate 102 via a base bracket 124 (better shown in FIG. 2). Accordingly, the apparatus 100 may include a first base bracket 124-1 (better shown in FIG. 2) coupling the first knee stopper 122-1 to the corresponding (i.e. first) foot plate 102-1 and a second base bracket 124-2 (better shown in FIG. 2) coupling the second knee stopper 122-2 to the corresponding (i.e. second) foot plate 102-2. Due to direct contact of each of the knee stopper 122 with the legs (i.e., lower legs) of the user, the knee stopper 122 may be subjected to a significant amount of pressure/force from the legs of the user during the squatting. The inclusion of the base brackets 124 to couple each knee stopper 122 to the corresponding footplates 102 provides sufficient strength to each of the knee stopper 122 to withstand the applied pressure/force by the legs of the user.

As mentioned above, each of the knee stopper 122 is in direct contact with the legs of the user, so to ensure comfort to legs of the user, each of the knee stopper 122 may be covered with a cover 125 made of soft material (shown in FIG. 2). In some embodiments, the cover 125 may be made of skin friendly material, for example, soft plastic and other suitable materials. The knee stopper 122-1 may be covered with the cover 125-1 and the knee stopper 122-2 may be covered with the cover 125-2.

As shown in FIGS. 1 to 6, each of the knee stopper 122 (122-1 or 122-2) extends arcuately from a first end 126 (126-1 or 126-2) coupled to the corresponding foot plate 102 (102-1 or 102-2) to a free end 128 (128-1 or 128-2) disposed opposite to the first end 126 (126-1 or 126-2). Moreover, each of the knee stoppers 122 includes at least a first bar 132, a second bar 134, and a third bar 136. As shown, the third bar 136 extends upwardly at an angle from the first end 126 of the knee stopper 122. The second bar 134 is connected to the third bar 136 at a specific angle and the first bar 132 is orthogonally connected to the second bar 134 and extends from the second bar 134 to the free end 128 of the knee stopper 122. In an example, the knee stopper 122-1 includes a first bar 132-1, a second bar 134-1, and a third bar 136-1. In an example, the knee stopper 122-2 includes a first bar 132-2, a second bar 134-2, and a third bar 136-2.

Moreover, the apparatus 100 further includes a knee stopper knob 138 to facilitate an adjustable connection between the knee stopper 122 and the corresponding foot plate 102. In an example, a knee stopper knob 138-1 is provided for the knee stopper 122-1 and a knee stopper knob 138-2 is provided for the knee stopper 122-2. Specifically, the third bar 136 of the knee stopper 122 is adjustably connected to the corresponding foot plate 102 of the pair of footplates via the associate knee stopper knob 138. The knee stopper knob 138 is configured to allow forward or backward movement of the third bar 136 to adjust a horizontal distance between the first bar 132 and an end portion 110 of the corresponding foot plate 102 and a vertical distance between the first bar 132 and the corresponding foot plate 102. The first bar 132 restricts forward knee movement of the user during squatting and the second bar 134 restricts inward knee movement of the user during squatting by at least partially contacting the legs of the user.

The horizontal distance between the first bar 132 and the end portion 110 of the corresponding foot plate 102 may be adjusted by changing the knob position of the knee stopper knob 138. The horizontal distance may be considered to be a distance between the projection of the first bar 132 on a surface of the corresponding foot plate 102-1 or 102-2 and the rear end 110-1 or 110-2 of the corresponding foot plate 102-1 or 102-2. The vertical distance between the first bar 132 and the corresponding foot plate 102-1 or 102-2 may be considered to be an orthogonal distance between the first bar 132 and the corresponding foot plate 102-1 or 102-2.

As evident from the illustration of FIGS. 1-6, by adjusting the knee stopper knob 138, the third bar 136 moves either forward or backward from its rest position, thus changing the vertical distance between the first bar 132 and the corresponding foot plate 102-1 or 102-2. In concurrence to the change in the vertical distance, the forward or backward movement of the third bar 136 also results in a change in the horizontal distance between the first bar 132 and an end portion 110 of the corresponding foot plate 102-1 or 102-2.

Without restricting the scope of the disclosure, it would be appreciated that the adjustment of the knee stopper knob 138 may cause concurrent changes in the vertical distance between the first bar 132 and the corresponding foot plate 102-1 or 102-2 and the horizontal distance between the first bar 132 and an end portion of the corresponding foot plate 102-1 or 102-2. This results in users of different height to use the apparatus 100 appropriately. The knee stopper knob 138 makes the apparatus 100 adjustable to users with different height. This is enabled due to the adjustment of the vertical height or the horizontal distance or a combination of both by the knee stopper knob 138 which causes the forward/backward movement of the third bar 136.

Figure 7:
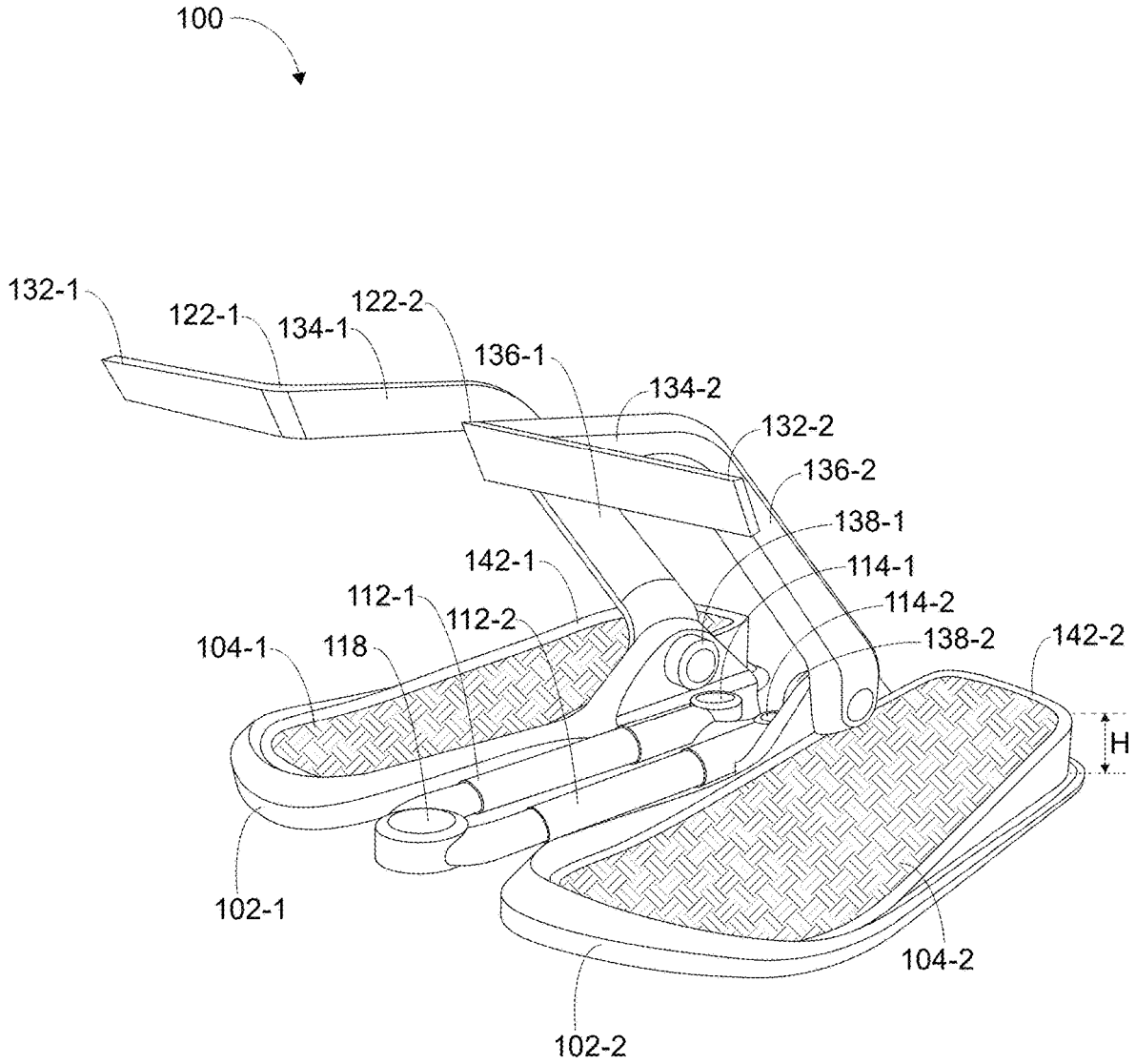
FIG. 7 illustrates a perspective view of the apparatus of FIG. 1, in accordance with another embodiment of the present disclosure.

FIG. 7 illustrates a perspective view of the apparatus 100, in accordance with another embodiment of the present disclosure. The apparatus 100 includes a wedge 142 on each foot plate 102-1, 102-2 of the pair of footplates 102. The wedge 142 may be provided on the corresponding foot plate 102 towards a heel portion of the foot plate 102. A wedge 142-1 may be provided for the foot plate 102-1 and a wedge 142-2 may be provided for the foot plate 102-2. In some embodiments, the pair of anti-skid pads 104 may not be provided on the corresponding foot plate 102 and the wedge 142 may be directly disposed on the corresponding foot plate 102. The wedge 142 may enable the user to position a heel (i.e., heel portion) of the foot of the user at a higher position than a sole portion (i.e., toe portion) of the foot of the user. This reduces weight load from hips and ankles of the user, thereby increasing their squat depth. Accordingly, the user is able to reach a deeper squat even if they have limited range of motion at ankles/hips.

In an alternative embodiment, the entire wedge may be replaced with another wedge with a different height H, thus making it possible to adjust the wedge height. The adjustment of height makes it possible to elevate the whole foot between for example, and not limited to, 5-20 degrees. This elevation is important because this will improve the squat depth and shift the tension from lower back to legs.

Figure 8:
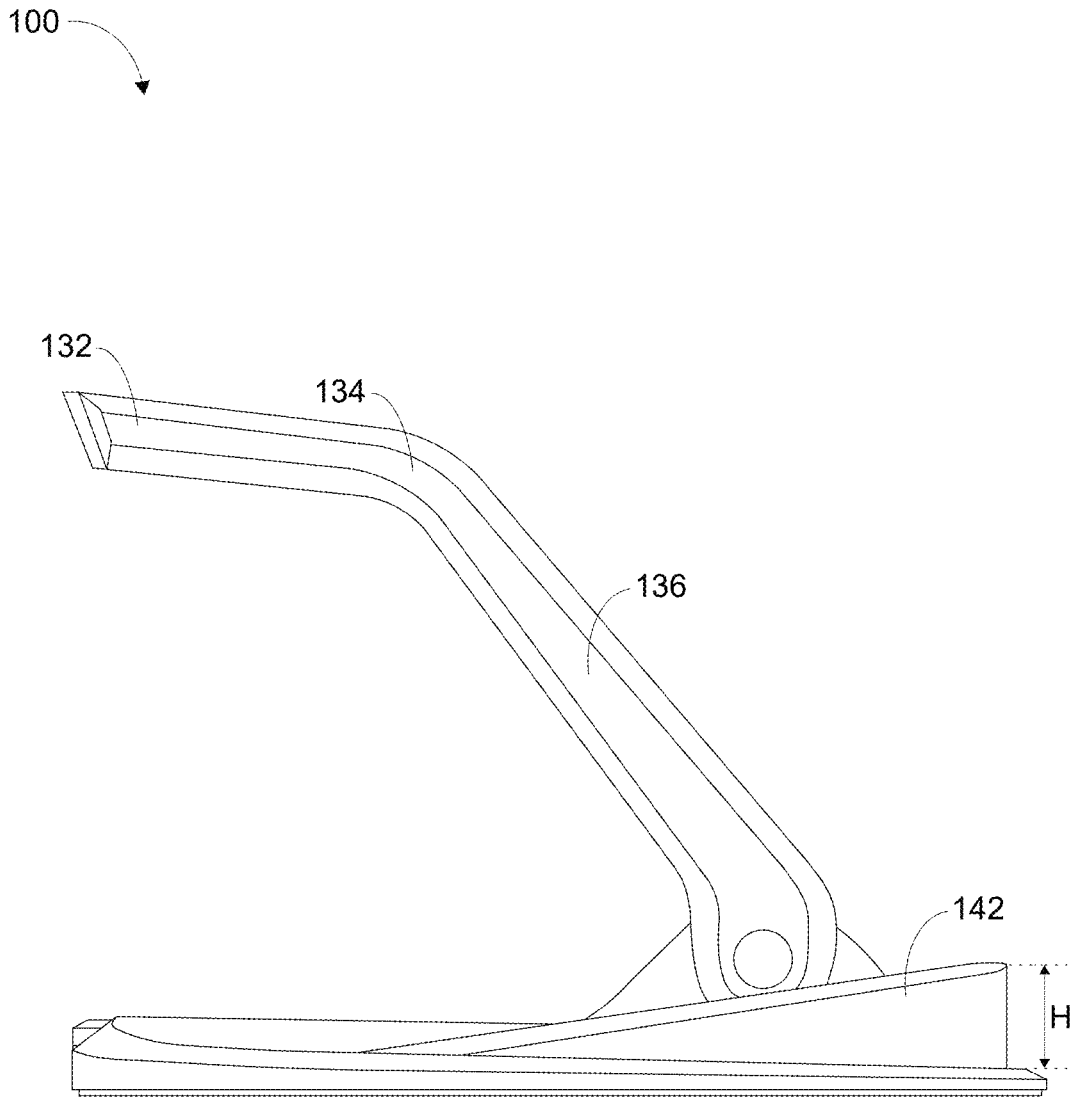
FIG. 8 illustrates a side view of the apparatus of FIG. 7, in accordance with another embodiment of the present disclosure.

FIG. 8 illustrates a side view of the apparatus 100, in accordance with another embodiment of the present disclosure. In some embodiments, a height 'H' of the wedge 142 may vary in a range of 1 cm to 3 cm, preferably 2 cm. In other words, the heel portion of the user may be positioned 1 cm to 3 cm, preferably 2 cm higher than the sole portion of the foot of the user. In some embodiments, different wedges according to different user heights may be used the apparatus 100. This enables the user to select an appropriate heel elevation/height based on one or more parameters, such as their height and/or leg length, thereby achieving a desired heel that is optimally suited for their height.

Figure 9:
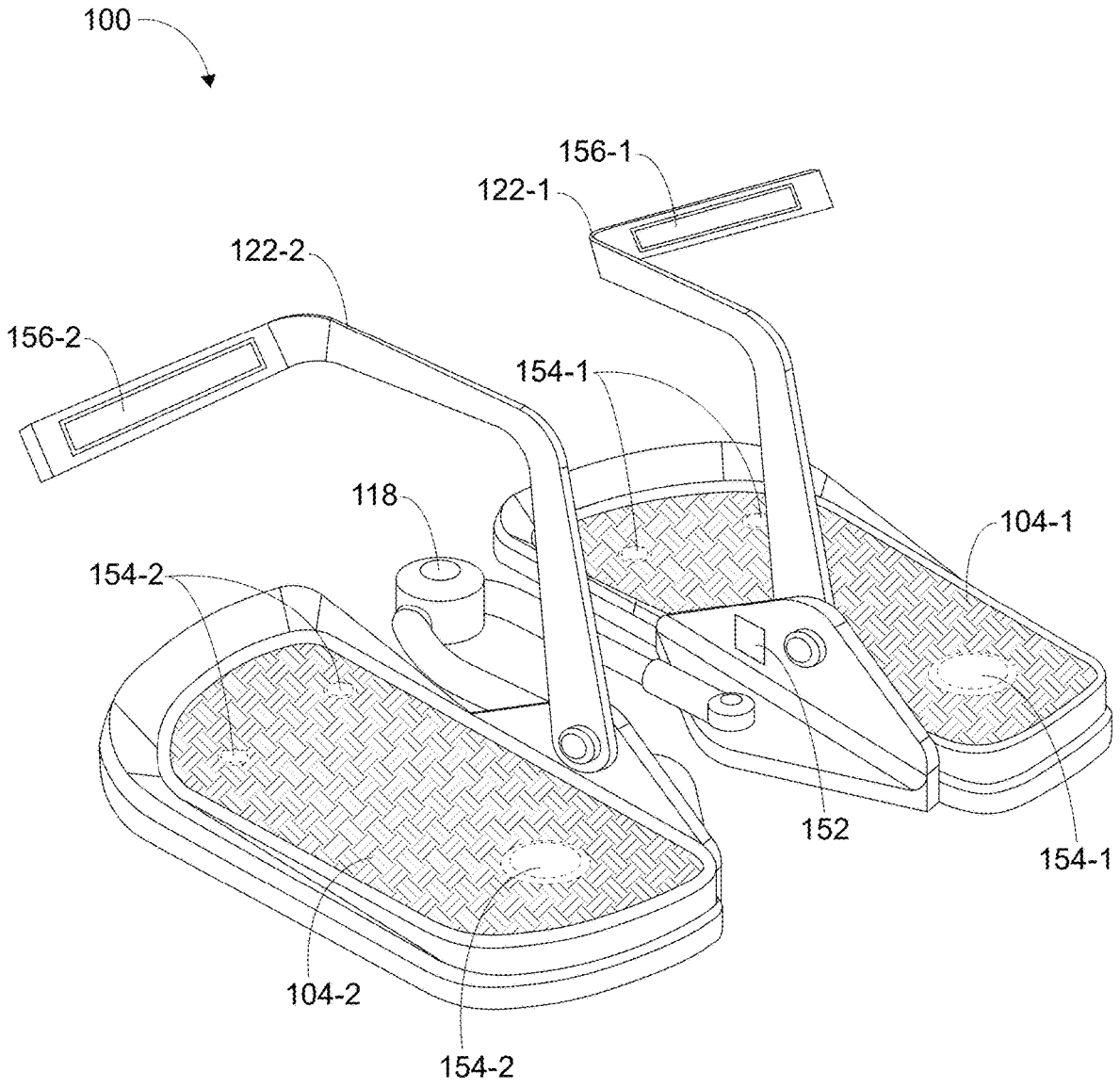
FIG. 9 illustrates a perspective view of the apparatus of FIG. 1, in accordance with another embodiment of the present disclosure.

FIG. 9 illustrates a perspective view of the apparatus 100, in accordance with another embodiment of the present disclosure. In some embodiments, the apparatus 100 may further include a processor 152 and a plurality of sensors disposed on the apparatus 100. In the illustrated embodiment, the apparatus 100 includes a first plurality of pressure sensors 154 disposed on each footplate 102 of the pair of the footplates and a second plurality of sensors 156 disposed on the first bar 132 of the knee stopper 1. The first plurality of pressure sensors 154 may be disposed on each footplate 102 along tripod foot positions. Further, each pressure sensor of the first plurality of pressure sensors 154 is configured to detect a weight exerted by the user at a specific position on the corresponding footplate 102 during squatting and output the detected weight to the processor 152. A plurality of sensors 154-1 may be disposed on the first footplate 102-1 and a plurality of sensors 154-2 may be disposed on the second footplate 102-2. Similarly, a plurality of sensors 156-1 may be disposed on the first bar 132-1 and a plurality of sensors 156-2 may be disposed on the second bar 132-2.

In an embodiment, the plurality of sensors may communicate with the processor 152 wirelessly or through wired communication. A battery (not illustrated in FIG. 9) may be provided with the apparatus 100 to supply electrical power to the plurality of sensors and the processor 152.

In the illustrated embodiment of FIG. 9, the plurality of first pressure sensors 154 may be embedded inside the anti-skid pad 104 of the corresponding foot plate 102 at a first position, a second position, and a third position. As shown, the first position in the tripod foot positions corresponds to a position where a heel of the user contacts the corresponding foot plate 102. The second position in the tripod foot positions corresponds to a position where a big toe of the user contacts the corresponding foot plate 102. Further, the third position in the tripod foot positions corresponds to a position where a pinky toe of the user contacts the corresponding foot plate 102.

Upon receiving the output from the first plurality of pressure sensors 154, the processor 152 is configured to determine distribution of weight along the tripod foot positions based on the detected weight. If the processor 152 determines an uneven weight distribution along the tripod foot positions, the processor 152 is configured to output a signal to notify the user that the distribution of weight along the tripod foot positions is uneven. The processor 152 is further configured to control, based on the output signal, at least one of a speaker, a display screen, or a haptic device to notify the user about the uneven distribution of weight along the tripod foot positions. Without restricting the scope of the apparatus 100, the speaker, the display screen and the haptic device may not be a part of the apparatus 100.

The processor 152 may include suitable logic, circuitry, and interfaces that may be configured to execute program instructions associated with a set of operations to be executed to determine weight distribution, provide the output signal or control the speaker, the display screen, or the haptic device. The processor 152 may include one or more processing units, which may be implemented as an integrated processor or a cluster of processors that perform the functions of the one or more processing units, collectively. The processor 152 may be implemented based on a number of processor technologies known in the art. Example implementations of the processor 152 may include, but are not limited to, an x86-based processor, a Graphics Processing Unit (GPU), a Reduced Instruction Set Computing (RISC) processor, an Application-Specific Integrated Circuit (ASIC) processor, a Complex Instruction Set Computing (CISC) processor, a microcontroller, a central processing unit (CPU), and/or other computing circuits.

The display device may include suitable logic, circuitry, interfaces, and/or code that may be configured to display a notification for the user based on the output signal or display an avatar of the user, or display a 3D model mimicking the user while exercising. The display device may be realized through several known technologies such as, but not limited to, a Liquid Crystal Display (LCD) display, a Light Emitting Diode (LED) display, a plasma display, and/or an Organic LED (OLED) display technology, and/or other display technologies. In accordance with an embodiment, the display device may refer to a display screen of smart-glass device, a 3D display, a see-through display, a projection-based display, an electro-chromic display, and/or a transparent display.

The haptic device may be, for example, a haptic glove or a haptic suit for generation of a feedback signal and subsequent rendering of a haptic feedback. The haptic device is controlled by the processor 152 to provide a sense of information to the user when the processor 152 determines that the weight distribution is uneven. This way, the user may correct his posture after receiving such haptic feedback.

The haptic device may include suitable logic, circuitry, and interfaces that may be configured to generate haptic feedback. The haptic device may be worn on one or more anatomical portions of the body (such as hands, arms, chest, waist, hips, toes, or feet) of the user. In at least one embodiment, the haptic device may be a full body suit with actuators spread throughout the surface of the suit at predefined locations. The generated haptic feedback may cause the user to experience a tactile sensation on the one or more anatomical portions of user's body. In some embodiments, the haptic device may include sensors, such as tactile sensors that may allow measurement of force of movement of the one or more anatomical portions of the body of the user (in real-world) or pressure of a human touch on the haptic device which may be in contact with the one or more anatomical portions. The sensors may detect the force or pressure during activities such as while squatting. Based on the detection movement or pressure, the haptic device may generate the haptic feedback.

Examples of the haptic device may include, but are not limited to, a haptic glove, a wired glove with haptic actuators, a gaming glove with haptic actuators, a wearable fingertip haptic device (such as a haptic thimble or a touch thimble), a graspable haptic device (which may generate kinesthetic sensations, such as a sensation of movement, position and force in skin, muscles, tendons, and joints of a wearer), or a wearable device (which generates tactile sensations, such as a pressure, friction, or temperature in the skin of a wearer), joysticks with haptic actuators, mouse, finger pad, robotic handle, gripper, a humanoid robotic hand with haptic actuators, a wearable garment with haptic actuators, a wearable device with haptic actuators, or any device in a form of a wearable belt with haptic actuators.

Further, the second plurality of sensors 156 may be disposed on the first bar 132 of the knee stopper 122. The second plurality of sensors 156 is configured to detect pressure applied on the first bar 132 due to forward knee movement of the user during squatting and output the detected pressure to the processor 152. Upon receiving the output from the second plurality of sensors 156, the processor 152 is configured to determine an extent of the forward knee movement of the user during squatting, based on the detected pressure on the first bar 132.

If the processor 152 determines that the extent of the forward knee movement is greater than a threshold value, the processor 152 is further configured to output a signal to notify the user based on the determination that the extent of the forward knee movement is greater than the threshold value. The threshold value of the forward knee movement may vary based on the different types of squats. The threshold value is also dependent on the height of the user doing the squat on the apparatus 100. In an embodiment, the user may input this threshold value to the processor 152 via an input device. The input device may include for example, but not limited to, a keyboard, a mouse, a graphical user interface, a voice controlled device etc. The processor 152 is further configured to control at least one of the speaker, the display screen, or the haptic device, based on the output signal to notify the user about the forward knee movement being extended beyond the threshold value.

In some embodiments, the processor 152 may onboard the apparatus 100 and arranged in a wired or wireless communications with the first plurality of pressure sensors 154 and the second plurality of sensors 156. In another embodiment, the processor 152 may be placed remotely or external to the apparatus 100 communicating with the first plurality of pressure sensors 154 and the second plurality of sensors 156 wirelessly.

In some embodiments, the processor 152 of the apparatus 100 may communicate with a plurality of wearable sensors configured to be attached to the user's body. The wearable sensors may be equipped with mechanical and electrical components that measure position and orientation in physical space and then translate that information to construct a 3-dimensional avatar of the user. In some embodiments, the wearable sensors may be comprised of electromagnetic receivers and emitters, one or more optical elements, infrared emitters, accelerometers, magnetometers, gyroscopes, or a combination thereof. The plurality of wearable sensors may wirelessly communicate with the processor 152. Additionally, the processor 152 may further include a memory (not shown) having information related to pre-stored movements of the user during different squatting exercise.

Figure 10:
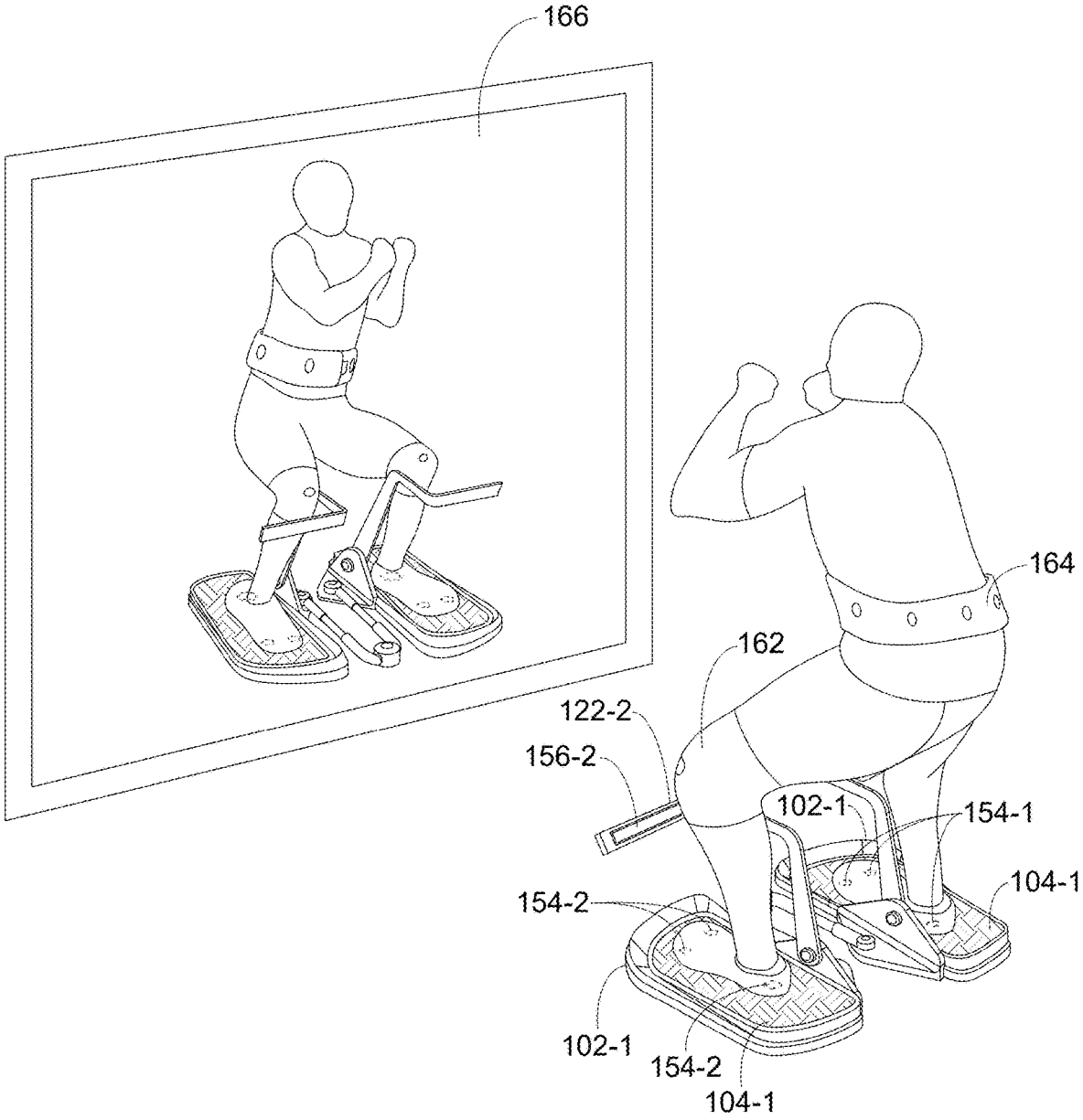
FIG. 10 illustrates a perspective view of the apparatus of FIG. 1, in accordance with another embodiment of the present disclosure.

In the illustrated embodiment of FIG. 10, the plurality of wearable sensors includes one or more knee sleeves sensors 162 and a waist belt 164 having multiple sensors to monitor knee position, squat position, and posture of the user. Further, the sensors of the knee sleeves and the waist belt may be configured to provide data related to the postures, knee movements, and squat position of the user. Further, the knee sleeve sensors 162 monitors the knee position in relation to the toe.

The processor 152 is configured to execute digital or analog processing operations on the data gathered from the first plurality of sensors 154, the second plurality of sensors 156, the knee sleeve sensors 162, and the waist belt sensor 164. In an alternative embodiment, the apparatus 100 may include additional sensors that capture gyro, compass, or accelerometer data to derive a pose of the user doing the squatting exercise on the apparatus 100. Using the data gathered from the first plurality of sensors 154, the second plurality of sensors 156, the knee sleeve sensors 162, and the waist belt sensor 164, and the captured gyro, compass, or accelerometer data, the processor 152 may create an avatar of the user.

The avatar of the user may be displayed on a display device or display screen 166 (shown in FIG. 10). Moreover, the processor 152 may be further configured to control the display screen 166 to display the avatar of the user during squatting. Further, the processor 152 is configured to compare movements of the avatar during squatting with pre-stored movements. The processor 152 is further configured to control the display screen 166 to display a message that notifies the user of incorrect movements during squatting, based on the movements of the avatar being different from the pre-stored movements by a threshold value.

Figure 11:
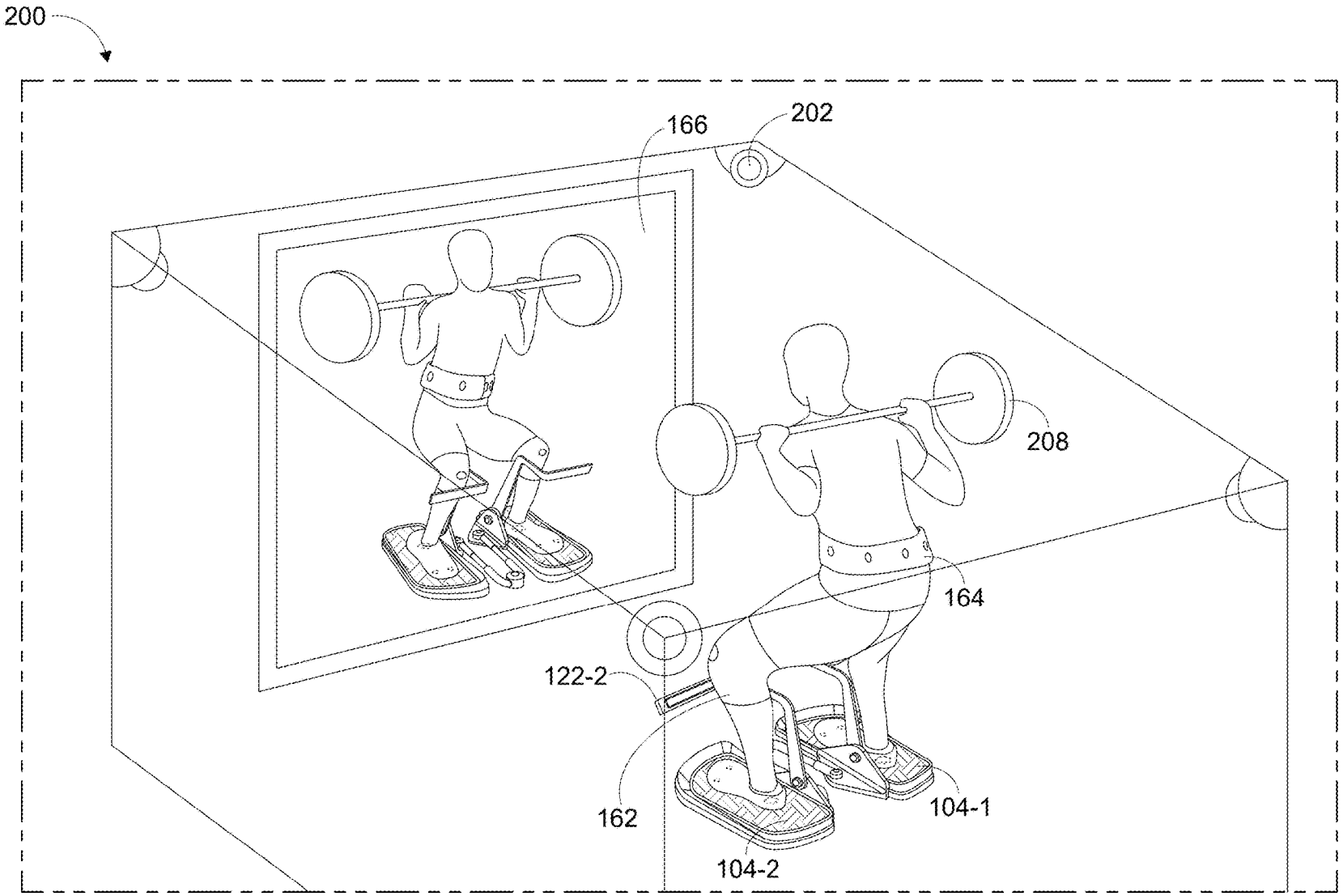
FIG. 11 illustrates a pictorial representation of a remotely guided environment, according to another embodiment of the present disclosure.

Referring to FIG. 11, a pictorial representation of a remotely guided environment 200 is shown, according to another embodiment of the present disclosure. As shown, the environment 200 is further equipped with at least one image capturing device 202 configured to capture a plurality of images of the user during the squatting exercise. In an example, the user may be doing squatting exercise with a barbell rod 208 on shoulders. The processor 152 is configured to receive at least one image of the user from at least one image capturing device 202, during squatting. The plurality of images of the user during the squatting exercise along with the combined data from the first plurality of sensors 154, the second plurality of sensors 156, the knee sleeves sensors 162 and the waist belt sensor 164 is used to create the avatar of the user. In alternative embodiments, the captured gyro, compass, or accelerometer data may also be used to create avatar of the user and simulate a 3D model of the user doing the exercise.

It will be appreciated that, for clarity purposes, the above description has described embodiments of the invention with reference to different functional units and processors. However, it will be apparent that any suitable distribution of functionality between different functional units, processors or domains may be used without detracting from the invention. For example, functionality illustrated to be performed by separate processors or controllers may be performed by the same processor or controller. Hence, references to specific functional units are only to be seen as references to suitable means for providing the described functionality, rather than indicative of a strict logical or physical structure or organization.

Although the present invention has been described in connection with some embodiments, it is not intended to be limited to the specific form set forth herein. Rather, the scope of the present invention is limited only by the claims. Additionally, although a feature may appear to be described in connection with particular embodiments, one skilled in the art would recognize that various features of the described embodiments may be combined in accordance with the invention.

Furthermore, although individually listed, a plurality of means, elements or process steps may be implemented by, for example, a single unit or processor. Additionally, although individual features may be included in different claims, these may possibly be advantageously combined, and the inclusion in different claims does not imply that a combination of features is not feasible and/or advantageous. Also, the inclusion of a feature in one category of claims does not imply a limitation to this category, but rather the feature may be equally applicable to other claim categories, as appropriate.

What is claimed is:

1. A portable and foldable apparatus for supporting a user in maintaining correct posture during squatting, the apparatus comprising:

a pair of footplates to accommodate feet of the user;

a pair of telescoping arms, wherein a first telescoping arm of the pair of telescoping arms is connected to a first footplate of the pair of footplates, and a second telescoping arm of the pair of telescoping arms is connected to a second footplate of the pair of footplates;

a stance pivot knob that connects the first telescopic arm with the second telescopic arm and configured to adjust angular distance between the first telescopic arm and the second telescopic arm;

a knee stopper knob for each of the pair of footplates; and a knee stopper for each of the pair of footplates, wherein the knee stopper includes at least a first bar, a second bar, and a third bar, the third bar is adjustably connected to a corresponding footplate of the pair of footplates via the knee stopper knob, the first bar is orthogonally connected to the second bar, the second bar is connected to the third bar at a specific angle, the first bar restricts forward knee movement of the user during squatting, the second bar restricts inward knee movement of the user during squatting, and the knee stopper knob is configured to allow forward or backward movement of the third bar to adjust a horizontal distance between the first bar and an end portion of the corresponding footplate and a vertical distance between the first bar and the corresponding footplate.

2. The apparatus of claim 1, further comprising a footplate angle knob for each of the pair of footplates, wherein the footplate angle knob adjustably connects each telescopic arm with the corresponding footplate, and the footplate angle knob is configured to allow adjustment of angular distance between each telescopic arm and a side of the corresponding footplate.

3. The apparatus of claim 1, further comprising a pair of anti-skid pads, wherein each anti-skid pad of the pair of skid pads is disposed on the corresponding footplate.

4. The apparatus of claim 1, wherein each telescopic arm of the pair of telescopic arms is configured to extend or retract with respect to a point of connection with the corresponding footplate to accommodate different types of squats.

5. The apparatus of claim 1, further comprising a wedge on each footplate of the pair of footplates.

6. The apparatus of claim 1, further comprising a processor, wherein each footplate of the pair of footplates comprises a first plurality of pressure sensors, the first plurality of pressure sensors is disposed on each footplate along tripod foot positions, and each pressure sensor of the first plurality of pressure sensors is configured to:

detect a weight exerted by the user at a specific position on the corresponding footplate during squatting; and output the detected weight to the processor.

7. The apparatus of claim 6, wherein the processor is configured to:

determine distribution of weight along the tripod foot positions based on the detected weight; and based on the determination that the distribution of weight along the tripod foot positions is uneven, output a signal to notify the user.

8. The apparatus of claim 7, wherein the processor is further configured to control, based on the output signal, at least one of a speaker, a display screen, or a haptic device to notify the user about the uneven distribution of weight along the tripod foot positions.

9. The apparatus of claim 7, wherein the processor is further configured to determine the distribution of weight to be uneven when weights on the tripod foot positions are unequal.

10. The apparatus of claim 6, wherein a first position in the tripod foot positions corresponds to a position where a heel of the user contacts the corresponding footplate, a second position in the tripod foot positions corresponds to a position where a big toe of the user contacts the corresponding footplate, and a third position in the tripod foot positions corresponds to a position where a pinky toe of the user contacts the corresponding footplate.

11. The apparatus of claim 6, further comprising a second plurality of sensors disposed on the first bar of the knee stopper, wherein the second plurality of sensors is configured to:

detect pressure applied on the first bar due to forward knee movement of the user during squatting; and output the detected pressure to the processor.

12. The apparatus of claim 11, wherein the processor is configured to:

determine an extent of the forward knee movement of the user during squatting, based on the detected pressure on the first bar; and based on the determination that the extent of the forward knee movement is greater than a threshold value, output a signal to notify the user.

13. The apparatus of claim 12, wherein the processor is further configured to control, based on the output signal, at least one of a speaker, a display screen, or a haptic device to notify the user about the forward knee movement being extended beyond the threshold value.

14. The apparatus of claim 11, wherein the processor is configured to:

receive, from at least one image capturing device, at least one image of the user during squatting;

create an avatar of the user based on the at least one image of the user during squatting, the weight detected by the first plurality of sensors, and the pressure detected by the second plurality of sensors; and control a display screen to display the avatar of the user during squatting.

15. The apparatus of claim 14, wherein the processor is further configured to:

compare movements of the avatar during squatting with pre-stored movements; and based on the movements of the avatar being different from the pre-stored movements by a threshold value, control the display screen to display a message that notifies the user of incorrect movements during squatting.

* * * * *